US009589568B2

(12) United States Patent
Jeong et al.

(10) Patent No.: US 9,589,568 B2
(45) Date of Patent: Mar. 7, 2017

(54) METHOD AND DEVICE FOR BANDWIDTH EXTENSION

(75) Inventors: Gyu Hyeok Jeong, Seoul (KR); Young Han Lee, Gwangju (KR); Hye Jeong Jeon, Seoul (KR); Hong Kook Kim, Gwangju (KR); In Gyu Kang, Seoul (KR); Lag Young Kim, Seoul (KR)

(73) Assignees: LG Electronics Inc., Seoul (KR); Gwangju Institute Of Science and Technology, Gwangju (KR)

( * ) Notice: Subject to any disclaimer, the term of this patent is extended or adjusted under 35 U.S.C. 154(b) by 394 days.

(21) Appl. No.: 13/984,182

(22) PCT Filed: Feb. 8, 2012

(86) PCT No.: PCT/KR2012/000910

§ 371 (c)(1),
(2), (4) Date: Aug. 7, 2013

(87) PCT Pub. No.: WO2012/108680

PCT Pub. Date: Aug. 16, 2012

(65) Prior Publication Data

US 2013/0317812 A1 Nov. 28, 2013

Related U.S. Application Data

(60) Provisional application No. 61/440,843, filed on Feb. 8, 2011, provisional application No. 61/479,405, filed on Apr. 27, 2011.

(51) Int. Cl.

| | |
|---|---|
| ***G10L 19/00*** | (2013.01) |
| ***G10L 19/02*** | (2013.01) |
| ***G10L 21/0388*** | (2013.01) |

(52) U.S. Cl.

CPC ..... *G10L 19/00* (2013.01); *G10L 19/0212* (2013.01); *G10L 21/0388* (2013.01)

(58) Field of Classification Search

CPC ..... G10L 21/0388; G10L 19/0212

See application file for complete search history.

(56) References Cited

U.S. PATENT DOCUMENTS

| | | | |
|---|---|---|---|
| 7,228,271 | B2 | 6/2007 | Tokuda et al. |
| 7,356,150 | B2 | 4/2008 | Ejima et al. |

(Continued)

FOREIGN PATENT DOCUMENTS

| | | | |
|---|---|---|---|
| CN | 1830148 | A | 9/2006 |
| EP | 1 653 627 | A1 | 5/2006 |

(Continued)

OTHER PUBLICATIONS

Chinese Office Action dated Aug. 20, 2014 for Chinese Application No. 201280015425.9, with English Translation, 14 pages.

(Continued)

*Primary Examiner* — Qian Yang
(74) *Attorney, Agent, or Firm* — Fish & Richardson P.C.

(57) ABSTRACT

Method and device of extending a signal band of a voice or audio signal are provided. The bandwidth extension method includes the steps of: performing a modified discrete cosine transform (MDCT) process on an input signal to generate a first transform signal; generating a second transform signal and a third transform signal on the basis of the first transform signal; generating normalized components and energy components of the first transform signal, the second transform signal, and the third transform signal therefrom; generating an extended normalized component from the normalized components and generating an extended energy component from the energy components; generating an extended transform signal on the basis of the extended normalized component and the extended energy component; and performing an inverse MDCT (IMDCT) process on the extended transform signal.

15 Claims, 7 Drawing Sheets

(56) References Cited

U.S. PATENT DOCUMENTS

| | | | | |
|---|---|---|---|---|
| 2003/0093271 | A1 | 5/2003 | Tsushima | |
| 2003/0118176 | A1 | 6/2003 | Tokuda et al. | |
| 2006/0227018 | A1 | 10/2006 | Ejima et al. | |
| 2006/0247922 | A1* | 11/2006 | Hetherington | G10L 21/02 704/208 |
| 2010/0063802 | A1 | 3/2010 | Gao | |
| 2010/0198587 | A1 | 8/2010 | Ramabadran et al. | |
| 2010/0256976 | A1* | 10/2010 | Atsmon | G06F 21/34 704/231 |

FOREIGN PATENT DOCUMENTS

| | | | |
|---|---|---|---|
| JP | 2003-256000 | A | 9/2003 |
| JP | 2010-020356 | A | 1/2010 |
| JP | 2010020251 | A | 1/2010 |
| JP | 2010085876 | A | 4/2010 |
| JP | 2010224321 | A | 10/2010 |
| JP | 04627548 | B2 | 11/2010 |
| WO | WO 2005/011127 | A1 | 2/2005 |
| WO | WO 2007/029796 | A1 | 3/2007 |

OTHER PUBLICATIONS

European Search Report dated Jun. 3, 2014 for EP Application No. 12745345.4, 10 pages.

Patrice Collen, "Techniques D'Enrichissement De Spectre Des Signaux Audionumeriques", Nov. 14, 2002 (Nov. 14, 2002), pp. 1-150, XP055119155.

Anibal J S Ferreira et al.; "A Fractal Self-Similarity Model for the Spectral Representation of Audio Signals", AES Convention 118; May 1, 2005 (May 1, 2005), pp. 1-11, XP040507275.

International Search Report dated Sep. 14, 2013 for Application No. PCT/KR2012/000910 with English Translation, 4 pages.

* cited by examiner

METHOD AND DEVICE FOR BANDWIDTH EXTENSION

CROSS REFERENCE TO RELATED APPLICATIONS

This application is a U.S. National Phase Application under 35 U.S.C. §371 of International Application PCT/KR2012/000910, filed on Feb. 8, 2012, which claims the benefit of U.S. Provisional Application No. 61/440,843, filed on Feb. 8, 2011 and U.S. Provisional Application No. 61/479,405, filed Apr. 27, 2011, the entire content of the prior applications is incorporated by reference.

TECHNICAL FIELD

The present invention relates to encoding and decoding of a voice signal, and more particularly, to a signal band transform technique.

BACKGROUND ART

With the advent of the ubiquitous age, demands for high-quality voice and audio services based thereon have increased more and more. In order to satisfy the increasing demands, there is a need for an efficient voice and/or audio codec.

With the advancement of networks, the bandwidth provided for the voice and audio services has been extended and a scalable voice and audio encoding/decoding method of providing a high-quality audio at a high bit rate and providing a voice or a middle-quality or low-quality audio at a low bit rate has been considered.

In the scalable encoding/decoding, the quality of the services can be improved and the encoding/decoding efficiency can be enhanced, by variably providing the bandwidth as well as the bit rate. For example, by reproducing a wideband (WB) signal from a super-wideband (SWB) signal when an input signal is the SWB signal or reproducing an SWB signal from a WB signal when an input signal is the WB signal.

Therefore, methods of generating an SWB signal from a WB signal have been studied.

SUMMARY OF INVENTION

Technical Problem

A technical purpose of the invention is to provide effective bandwidth extension method and device in encoding and decoding of an audio/voice signal.

Another technical purpose of the invention is to provide method and device of reconstructing a SWB signal on the basis of a WB signal in encoding and decoding of an audio/voice signal.

Another technical purpose of the invention is to provide method and device of extending a band in a decoding stage without transferring additional information from an encoding stage in encoding and decoding of an audio/voice signal.

Another technical purpose of the invention is to provide bandwidth extension method and device not causing performance degradation in spite of an increase in processing band in encoding and decoding of an audio/voice signal.

Another technical purpose of the invention is to provide bandwidth extension method and device capable of effectively preventing noise from occurring at the boundary between a lower band and an extended upper band in encoding and decoding of an audio/voice signal.

Technical Solution

According to an aspect of the invention, there is provided a bandwidth extension method including the steps of: performing a modified discrete cosine transform (MDCT) process on an input signal to generate a first transform signal; generating a second transform signal and a third transform signal on the basis of the first transform signal; generating normalized components and energy components of the first transform signal, the second transform signal, and the third transform signal therefrom; generating an extended normalized component from the normalized components and generating an extended energy component from the energy components; generating an extended transform signal on the basis of the extended normalized component and the extended energy component; and performing an inverse MDCT (IMDCT) process on the extended transform signal. Here, the second transform signal may be a signal obtained by spectrally extending the first transform signal to an upper frequency band, and the third transform signal may be a signal object by reflecting the first transform signal with respect to a first reference frequency band.

Specifically, the second transform signal may be a signal obtained by double extending the signal band of the first transform signal to the upper frequency band.

The third transform signal may be a signal obtained by reflecting the first transform signal with respect to an uppermost frequency of the first transform signal, and the third transform signal may be defined in an overlap bandwidth centered on the uppermost frequency of the first transform signal. Here, the third transform signal may be synthesized with the first transform signal in the overlap bandwidth.

The energy component of the first transform signal may be an average absolute value of the first transform signal in a first frequency section, the energy component of the second transform signal may be an average absolute value of the second transform signal in a second frequency section, the energy component of the third transform signal may be an average absolute value of the third transform signal in a third frequency section, the first frequency section may be present in a frequency section in which the first transform signal is defined, the second frequency section may be present in a frequency section in which the second transform signal is defined, and the third frequency section may be present in a frequency section in which the third transform signal is defined.

The widths of the first to third frequency sections may correspond to 10 continuous frequency bands of frequency bands in which the first to third transform signals, the frequency section in which the first transform signal is defined may correspond to 280 upper frequency bands continuous from a lowermost frequency band in which the first transform signal is defined, the frequency section in which the second transform signal is defined may correspond to 560 upper frequency bands continuous from the lowermost frequency band in which the first transform signal is defined, and the frequency section in which the third transform signal is defined may correspond to 140 frequency bands centered on an uppermost frequency band in which the first transform signal is defined.

On the other hand, the normalized signal of the first transform signal may be a ratio of the first transform signal to the energy component of the first transform signal, the normalized signal of the second transform signal may be a ratio of the second transform signal to the energy component of the second transform signal, and the normalized signal of the third transform signal may be a ratio of the third transform signal to the energy component of the third transform signal.

The extended energy component may be the energy component of the first transform signal in a first energy section with a frequency bandwidth of K in which the first transform signal is defined, may be an overlap of the energy component of the second transform signal and the energy component of the third transform signal in a second energy section which is an upper section with a bandwidth of K/2 from the uppermost frequency band of the first energy section, and may be the energy component of the second transform signal in a third energy section which is an upper section with a bandwidth of K/2 from an uppermost frequency band of the second energy section. Here, a weight may be given to the energy component of the third transform signal in a first half of the second energy section and a weight may be given to the energy component of the second transform signal in a second half of the second energy section.

The extended normalized component may be the normalized component of the first transform signal in a frequency band lower than the second reference frequency band and may be the normalized component of the second transform signal in a frequency band higher than the second reference frequency band, and the second reference frequency band may be a frequency band in which a cross correlation between the first transform signal and the second transform signal is the maximum.

The step of generating the extended normalized component and the extended energy component may include smoothing the extended energy component in an uppermost frequency band in which the extended energy component is defined.

According to another aspect of the invention, there is provided a bandwidth extension device including: a transform unit that performs a modified discrete cosine transform (MDCT) process on an input signal to generate a first transform signal; a signal generating unit that generates signals on the basis of the first transform signal; a signal synthesizing unit that synthesizes an extended band signal from the first transform signal and the signals generated by the signal generating unit; and an inverse transform unit that performs an inverse MDCT (IMDCT) process on the extended transform signal. Here, the signal generating unit generates a second transform signal by spectrally extending the first transform signal to an upper frequency band, generates a third transform signal by reflecting the first transform signal with respect to a first reference frequency band, and extracts normalized components and energy components from the first to third transform signals, and the signal synthesizing unit synthesizes an extended normalized component on the basis of the normalized components of the first transform signal and the second transform signal and synthesizes an extended energy component on the basis of the energy components of the first to third transform signals, and generates an extended band signal on the basis of the extended normalized component and the extended energy component.

The energy component of the first transform signal may be an average absolute value of the first transform signal in a first frequency section, the energy component of the second transform signal may be an average absolute value of the second transform signal in a second frequency section, and the energy component of the third transform signal may be an average absolute value of the third transform signal in a third frequency section.

The normalized signal of the first transform signal may be a ratio of the first transform signal to the energy component of the first transform signal, the normalized signal of the second transform signal may be a ratio of the second transform signal to the energy component of the second transform signal, and the normalized signal of the third transform signal may be a ratio of the third transform signal to the energy component of the third transform signal.

The extended energy component may be the energy component of the first transform signal in a first energy section with a frequency bandwidth of K in which the first transform signal is defined, may be an overlap of the energy component of the second transform signal and the energy component of the third transform signal in a second energy section which is an upper section with a bandwidth of K/2 from the uppermost frequency band of the first energy section, and may be the energy component of the second transform signal in a third energy section which is an upper section with a bandwidth of K/2 from an uppermost frequency band of the second energy section.

A weight may be given to the energy component of the third transform signal in a first half of the second energy section and a weight may be given to the energy component of the second transform signal in a second half of the second energy section.

The extended normalized component may be the normalized component of the first transform signal in a frequency band lower than the second reference frequency band and may be the normalized component of the second transform signal in a frequency band higher than the second reference frequency band, and the second reference frequency band may be a frequency band in which a cross correlation between the first transform signal and the second transform signal is the maximum.

Advantageous Effects

According to the invention, it is possible to effectively extend a bandwidth in encoding and decoding of an audio/voice signal.

According to the invention, it is possible to extend a bandwidth of an input WB signal to reconstruct a SWB signal in encoding and decoding of an audio/voice signal.

According to the invention, it is possible to extend a bandwidth in a decoding stage without transferring additional information from an encoding stage in encoding and decoding of an audio/voice signal.

According to the invention, it is possible to extend a bandwidth without performance degradation in spite of an increase in processing band in encoding and decoding of an audio/voice signal.

According to the invention, it is possible to effectively prevent noise from occurring at the boundary between a lower band and an extended upper band in encoding and decoding of an audio/voice signal.

MODE FOR INVENTION

Hereinafter, embodiments of the invention will be specifically described with reference to the accompanying drawings. When it is determined that detailed description of known configurations or functions involved in the invention makes the gist of the invention obscure, the detailed description thereof will not be made.

If it is mentioned that an element is "connected to" or "coupled to" another element, it should be under stood that still another element may be interposed therebetween, as well as that the element may be connected or coupled directly to another element.

Terms such as "first" and "second" can be used to describe various elements, but the elements are not limited to the terms. For example, an element named a first element within the technical spirit of the invention may be named a second element and may perform the same function.

Figure 1:
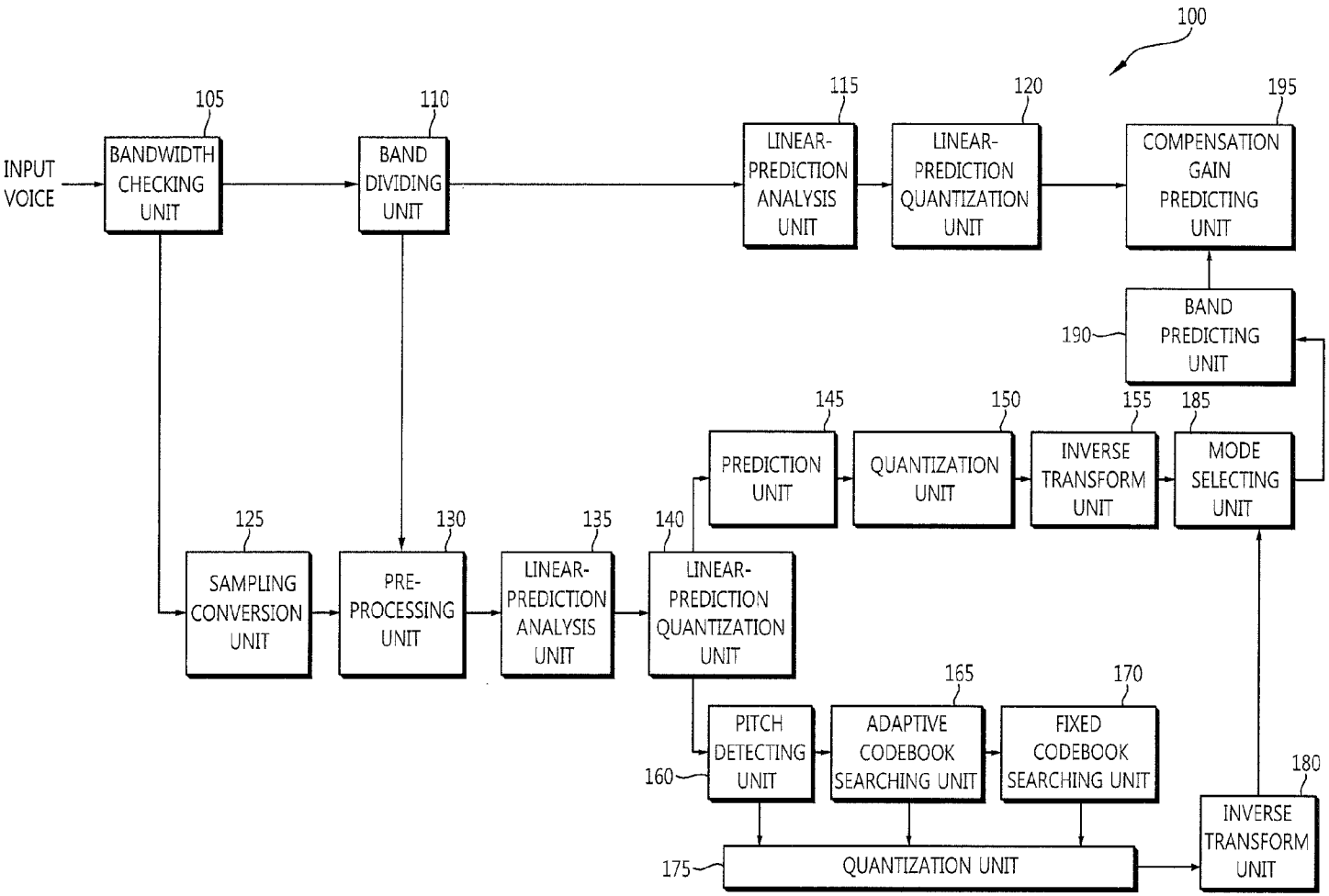
FIG. 1 is a diagram schematically illustrating a configuration example of a voice encoder according to the invention.

FIG. 1 is a diagram schematically illustrating a configuration example of a voice encoder according to the invention.

Referring to FIG. 1, a voice encoder 100 includes a bandwidth checking unit 105, a sampling conversion unit 125, a pre-processing unit 130, a band dividing unit 110, linear-prediction analysis units 115 and 135, linear-prediction quantizing units 140, 150, and 175, a transform unit 145, inverse transform units 155 and 180, a pitch detecting unit 160, an adaptive codebook searching unit 165, a fixed codebook searching unit 170, a mode selecting unit 185, a band predicting unit 190, and a compensation gain predicting unit 195.

The bandwidth checking unit 105 determines bandwidth information of an input voice signal. Voice signals can be classified into a narrowband signal with a bandwidth of about 4 kHz widely used in a public switched telephone network (PSTN), a wideband signal with a bandwidth of about 7 kHz widely used high-quality speech more natural than a narrowband voice signal or AM radio, and a super-wideband signal with a bandwidth of 14 kHz widely used in the field in which sound quality is emphasized such as digital broadcast, depending on the bandwidth. The bandwidth checking unit 105 transforms the input voice signal to a frequency domain and determines whether the input voice signal is a narrowband signal, or a wideband signal, or a super-wideband signal. The bandwidth checking unit 105 may transform the input voice signal to a frequency domain and may check and determine present and/or components of upper-band bins of a spectrum. The bandwidth checking unit 105 may not be provided separately when the bandwidth of a voice signal to be input is fixed depending on the implementation.

The bandwidth checking unit 105 transfers the super-wideband signal to the band dividing unit 110 and transfers the narrowband signal or the wideband signal to the sampling conversion unit 125, depending on the bandwidth of the input voice signal.

The band dividing unit 110 changes the sampling rate of the input signal and divides the input signal into an upper-band signal and a lower-band signal. For example, the frequency of a voice signal of 32 kHz is transformed to a sampling frequency of 25.6 kHz and the voice signal is divided into an upper band and a lower band by 12.8 kHz. The band dividing unit 110 transfers the lower-band signal to the pre-processing unit 130 and transfers the upper-band signal to the linear-prediction analysis unit 115.

The sampling conversion unit 125 receives the input narrowband signal or wideband signal and changes the sampling rate. For example, the sampling conversion unit changes the sampling rate to 12.8 kHz and generates an upper-band signal when the sampling rate of the input narrowband voice signal is 8 kHz, and changes the sampling rate to 12.8 kHz and generates a lower-band signal when the sampling rate of the input wideband voice signal is 16 kHz. The sampling conversion unit 125 outputs the lower-band signal of which the sampling rate is changed. The internal sampling frequency may be a sampling frequency other than 12.8 kHz.

The pre-processing unit 130 performs a pre-processing operation on the lower-band signal output from the sampling conversion unit 125 and the band dividing unit 110. The pre-processing unit 130 generates a voice parameter. A frequency component of an important band can be extracted, for example, using a filtering process such as a high-pass filtering method or a pre-emphasis filtering method. The extraction of the parameter can be concentrated on the important band by setting the cutoff frequency to be different depending on a voice bandwidth and high-pass-filtering a very-low frequency band which is a frequency band in which relatively less important information is gathered. For example, by boosting a high frequency band of the input signal using a pre-emphasis filtering method, the energy of a lower frequency band and a high frequency band can be scaled. Therefore, it is possible to raise the resolution in the linear prediction analysis.

The linear-prediction analysis units 115 and 135 calculate a linear prediction coefficient (LPC). The linear-prediction analysis units 115 and 135 can model a formant representing the whole shape of a frequency spectrum of a voice signal. The linear-prediction analysis units 115 and 135 calculate the LPC value so that the mean square error of error values which are differences between the original voice signal and the predicted voice signal generated using the linear prediction coefficient calculated by the linear-prediction analysis unit 135 is the smallest. Various methods such as an auto-correlation method or a covariance method are used to calculate the LPC.

The linear-prediction analysis unit 115 can extract a high-order LPC, unlike the linear-prediction analysis unit 135 for the low-band signal.

The linear-prediction quantizing units 120 and 140 converts the extracted LPC to generate transform coefficients in the frequency domain such as a linear spectral pair (LSP) or a linear spectral frequency (LSF) and quantize the generated transform coefficients in the frequency domain. The LPC has a wide dynamic range. Accordingly, when the LPC is transferred without any change, the compression rate thereof is lowered. Therefore, the LPC information can be generated with a small amount of information by transforming the LPC to the frequency domain and quantizing the transform coefficients.

The linear-prediction quantizing units 120 and 140 generate linear-prediction residual signals using the LPC transformed to the time domain by dequantizing the quantized LPC. The linear-prediction residual signal is a signal obtaining by removing the predicted formant component from the voice signal and includes pitch information and a random signal.

The linear-prediction quantizing unit 120 generates the linear-prediction residual signal through the filtering with the original upper-band signal using the quantized LPC. The generated linear-prediction residual signal is transferred to the compensation gain predicting unit 195 so as to calculate a compensation gain with the upper-band predicted excitation signal.

The linear-prediction quantizing unit 140 generates the linear-prediction residual signal through the filtering with the original lower-band signal using the quantized LPC. The generated linear-prediction residual signal is input to the transform unit 145 and the pitch detecting unit 160.

In FIG. 1, the transform unit 145, the quantization unit 150, and the inverse transform unit 155 can function as an RCX mode execution unit executing a transform coded excitation (TCX) mode. The pitch detecting unit 160, the adaptive codebook searching unit 165, and the fixed codebook searching unit 170 can function as a CELP mode execution unit executing a code excited linear prediction (CELP) mode.

The transform unit 145 transforms the input linear-prediction residual signal to the frequency domain on the basis of a transform function such as a discrete Fourier transform (DFT) or a fast Fourier transform (FFT). The transform unit 145 transfers the transform coefficient information to the quantization unit 150.

The quantization unit 150 quantizes the transform coefficients generated from the transform unit 145. The quantization unit 150 performs the quantization in various methods. The quantization unit 150 may selectively perform the quantization depending on the frequency band or may calculate the optimal frequency combination using an AbS (Analysis by Synthesis) method.

The inverse transform unit 155 performs an inverse transform process on the basis of the quantized information and generates the reconstructed excitation signal of the linear-prediction residual signal in the time domain.

The linear-prediction residual signal quantized and inversely transformed, that is, the reconstructed excitation signal, is reconstructed as a voice signal through the linear prediction. The reconstructed voice signal is transferred to the mode selecting unit 185. The voice signal reconstructed in the TCX mode is compared with the voice signal quantized and reconstructed in the CELP mode to be described later.

On the other hand, in the CELP mode, the pitch detecting unit 160 calculates the pitch of the linear-prediction residual signal using an open-loop method such as an autocorrelation method. For example, the pitch detecting unit 160 calculates the pitch period and the peak value by comparing the synthesized voice signal with an actual voice signal, and uses the AbS (Analysis by Synthesis) method or like at this time.

The adaptive codebook searching unit 165 extracts an adaptive codebook index and a gain on the basis of the pitch information calculated by the pitch detecting unit. The adaptive codebook searching unit 165 calculates a pitch structure from the linear-prediction residual signal on the basis of the adaptive codebook index and the gain information using the AbS method or the like. The adaptive codebook searching unit 165 transfers the contributing data of the adaptive codebook, for example, the linear-prediction residual signal from which information on the pitch structure is excluded, to the fixed codebook searching unit 170.

The fixed codebook searching unit 170 extracts and encode a fixed codebook index and a gain on the basis of the linear-prediction residual signal received from the adaptive codebook searching unit 165.

The quantization unit 175 quantizes parameters such as the pitch information output from the pitch detecting unit 160, the adaptive codebook index and the gain output from the adaptive codebook searching unit 165, and the fixed codebook index and the gain output from the fixed codebook searching unit 170.

The inverse transform unit 180 generates an excitation signal which is the linear-prediction residual signal reconstructed using the information quantized by the quantization unit 175. The inverse transform unit reconstructs a voice signal through the inverse process of the linear prediction on the basis of the excitation signal.

The inverse transform unit 180 transfers the voice signal reconstructed in the CELP mode to the mode selecting unit 185.

The mode selecting unit 185 compares the TCX excitation signal reconstructed in the TCX mode and the CELP excitation signal reconstructed in the CELP mode with each other and selects the excitation signal more similar to the original linear-prediction residual signal. The mode selecting unit 185 also encodes the information on in what mode the selected excitation signal is reconstructed. The mode selecting unit 185 transfers the selection information on the selection of the reconstructed voice signal and the excitation signal to the band predicting unit 190 as a bit stream.

The band predicting unit 190 generates a predicted excitation signal of an upper band using the selection information and the reconstructed excitation signal transferred from the mode selecting unit 185.

The compensation gain predicting unit 195 compares the upper-band predicted excitation signal transferred from the band predicting unit 190 and the upper-band predicted residual signal transferred from the linear-prediction quantizing unit 120 with each other and compensates for the gain in spectrum.

On the other hand, the constituent units in the example shown in FIG. 1 may operate as individual modules or plural constituent units may operate as a single module. For example, the quantization units 120, 140, 150, and 175 may operate as a single module or the quantization units 120, 140, 150, and 175 may be disposed at necessary positions in process as individual modules.

Figure 2:
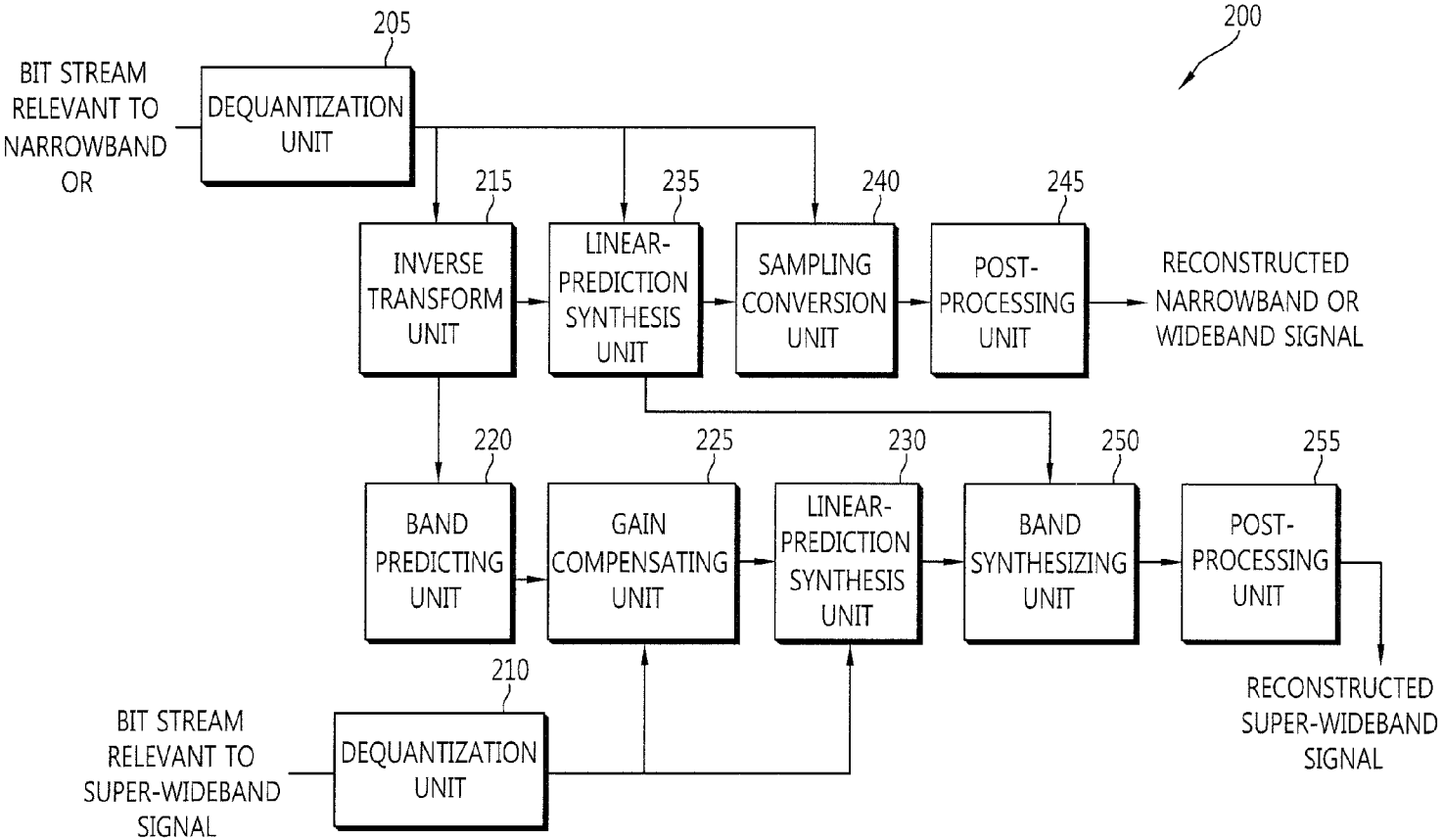
FIG. 2 is a conceptual diagram illustrating a voice decoder according to an embodiment of the invention.

FIG. 2 is a conceptual diagram illustrating a voice decoder according to an embodiment of the invention.

Referring to FIG. 2, the voice decoder 200 includes dequantization units 205 and 210, a band predicting unit 220, a gain compensating unit 225, an inverse transform unit 215, linear-prediction synthesis units 230 and 235, a sampling conversion unit 240, a band synthesizing unit 250, and post-process filtering units 245 and 255.

The dequantization units 205 and 210 receive the quantized parameter information from the voice encoder and dequantize the received parameter information.

The inverse transform unit 215 inversely transforms the voice information encoded in the TCX mode or the CELP mode to reconstruct the excitation signal. The inverse transform unit 215 generates the reconstructed excitation signal on the basis of the parameters received from the voice encoder. At this time, the inverse transform unit 215 may inversely transform only a partial band selected by the voice encoder. The inverse transform unit 215 transfers the reconstructed excitation signal to the linear-prediction synthesis unit 235 and the band predicting unit 220.

The linear-prediction synthesis unit 235 reconstructs a lower-band signal using the excitation signal transferred from the inverse transform unit 215 and the linear prediction coefficient transferred from the voice encoder. The linear-prediction synthesis unit 235 transfers the reconstructed lower-band signal to the sampling conversion unit 240 and the band synthesizing unit 250.

The band predicting unit 220 generates an upper-band predicted excitation signal on the basis of the reconstructed excitation signal received from the inverse transform unit 215.

The gain compensating unit 225 compensates for a gain in spectrum of a SWB voice signal on the basis of the upper-band predicted excitation signal received from the band predicting unit 220 and the compensation gain received from the voice encoder.

The linear-prediction synthesis unit 230 receives the compensated upper-band predicted excitation signal from the gain compensating unit 225 and reconstructs an upper-band signal on the basis of the compensated upper-band predicted excitation signal and the linear prediction coefficient received from the voice encoder.

The band synthesizing unit 250 receives the reconstructed lower-band signal from the linear-prediction synthesis unit 235, receives the reconstructed upper-band signal from the linear-prediction synthesis unit 435, and synthesizes the bands of the received upper-band signal and the received lower-band signal.

The sampling conversion unit 240 converts the internal sampling frequency into the original sampling frequency.

The post-process filtering units 245 and 255 perform post-processes necessary for reconstructing a signal. For example, the post-process filtering units 245 and 255 include a de-emphasis filter that can perforin the inverse filtering of the pre-emphasis filter in the pre-processing unit. The post-process filtering units 245 and 255 may perform various post-processes such as a quantization error minimizing process and a process of emphasizing harmonic peaks of a spectrum and de-emphasizing valleys, in addition to the filtering process. The post-process filtering unit 245 outputs a reconstructed narrowband or wideband signal and the post-process filtering unit 255 outputs a reconstructed super-wideband signal.

As described above, the voice encoder and the voice decoder shown in FIGS. 1 and 2 are only examples of the invention and can be variously modified without departing from the technical spirit of the invention.

On the other hand, a scalable encoding/decoding method is considered to provide effective voice and/or audio services.

In general, a scalable voice and audio encoder/decoder can variably provide a bandwidth as well as a bit rate. For example, a bandwidth is variably provided in a manner of reproducing a WB signal from an SWB signal when an input voice/audio signal is the SWB signal and reproducing an SWB signal from a WB signal when an input voice/audio signal is the SB signal.

The process of converting a WB signal into an SWB signal is performed through re-sampling.

However, when an up-sampling process is simply used to convert a WB signal into an SWB signal, the sampling rate is a sampling rate of an SWB signal but the bandwidth in which a signal is actually present is the same as the WB signal. As a result, the amount of information (that is, data rate) increases due to the up-sampling but the sound quality is not improved.

In this regard, a method of reconstructing an SWB signal from a WB signal or a narrowband (NB) signal without increasing a bit rate is referred to as an artificial bandwidth extension (ABE).

In this specification, a bandwidth extension method of receiving a WB signal or a lower-band signal and reconstructing an SWB signal therefrom without increasing a bit rate, for example, a wideband-to-super-wideband re-sampling method, will be described below in detail.

In the invention, an SWB signal is reconstructed using reflection band information and prediction band information of a WB signal in a modified discrete cosine transform (MDCT) domain which is a processing domain of the scalable voice and audio encoder.

As an initial voice codec, a codec such as G.711 processing a narrow band with a small amount of computation has been mainly developed due to restriction to the bandwidth of networks and the algorithm processing rate. In other words, a method of providing sound quality suitable for voice communication with a small amount of computation and a low bit rate has been used rather than a codec providing good sound quality by employing a complex method with a high bit rate.

Codec techniques with high complexity and good sound quality have been developed with the advancement of signal processing techniques and networks. For example, a narrowband voice codec processing only a bandwidth of 3.4 kHz or less and a wideband voice codec processing a bandwidth up to 7 kHz have been developed.

However, when the increase in demands for high-quality voice services is considered as described above, a method using a scalable codec capable of supporting a bandwidth equal to or larger than the wideband on the basis of a wideband voice codec can be considered. At this time, G729.1, G718, and the like can be used as the wideband voice codec.

The scalable codec supporting a super wideband on the basis of the wideband voice codec can be used in various cases. For example, it is assumed that one of two users communicating with each other using a call service has a terminal capable of processing only a WB signal and the other has a terminal capable of an SWB signal. In this case, a problem that a voice signal based on a WB signal instead of an SWB signal is provided to the user having the terminal capable of an SWB signal may occur to keep communications between the two users. This problem can be solved when the SWB signal can be re-sampled and reconstructed on the basis of the WB signal.

The voice codec according to the invention can process both the WB signal and the SWB signal and can reconstruct the SWB signal through the re-sampling based on the WB signal.

The ABE technique used for the re-sampling technique has been generally studied hitherto in such a way to reconstruct a WB signal on the basis of a NB signal.

The ABE technique can be classified into a spectral envelope prediction technique and an excitation signal prediction technique. An excitation signal can be predicted through modulation or the like. A spectral envelope can be predicted using a pattern recognition technique. Examples of the pattern recognition technique used to predict a spectral envelope include a Gauss mixture model (GMM) and a hidden Markov model (HMM).

As the ABE method of predicting a WB signal, a method of utilizing an MFCC (Mel-Frequency Cepstral Coefficient) using a voice recognition feature vector or utilizing an index of vector quantization (VQ) for quantizing the MFCC or the like has been studied.

Figure 3:
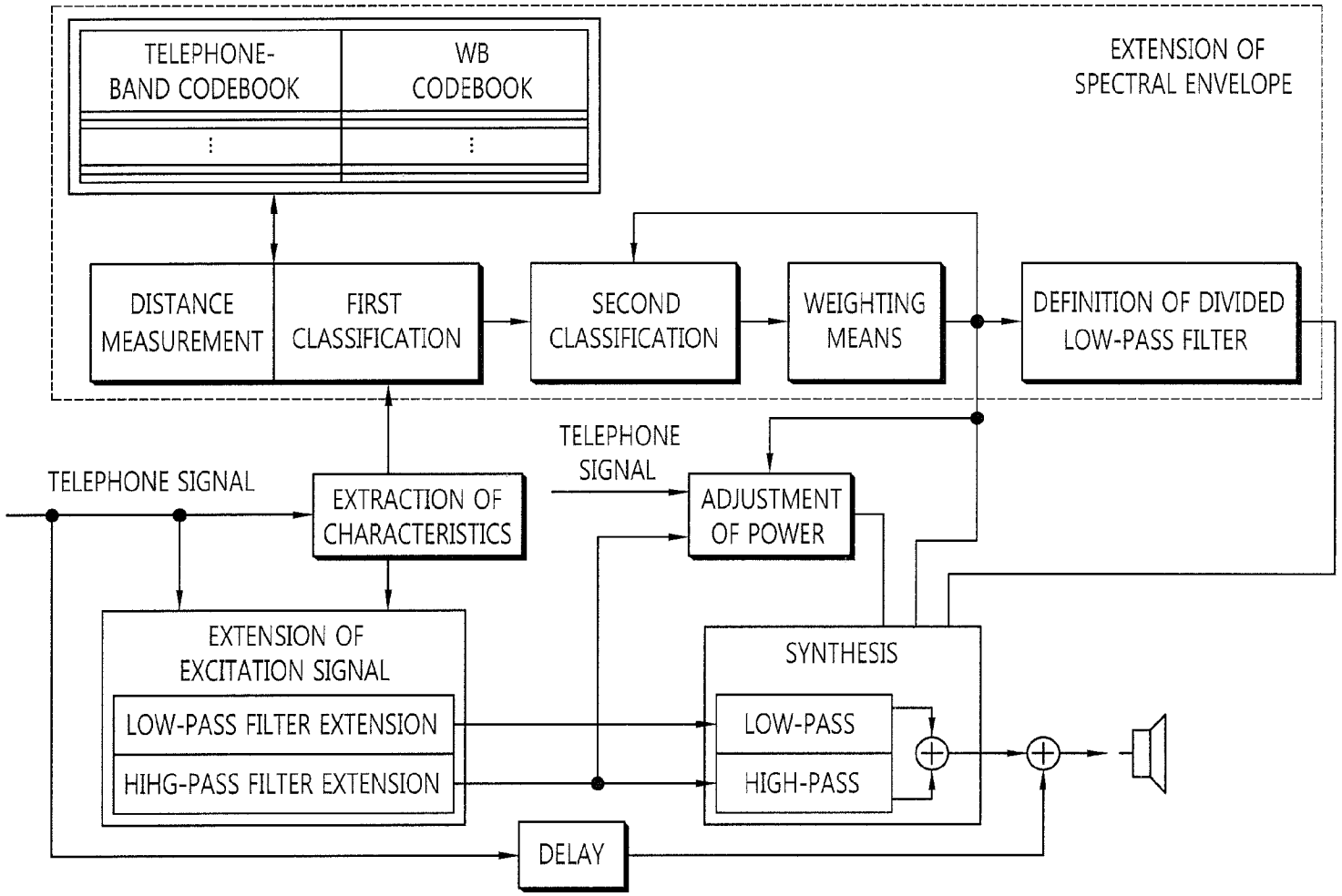
FIG. 3 is a diagram schematically illustrating an example where codebook-based spectral envelope prediction and divided-band excitation signal prediction are applied as an ABE method.

FIG. 3 is a diagram schematically illustrating an example where codebook-based spectral envelope prediction and divided-band excitation signal prediction are applied as the ABE method.

Referring to FIG. 3, a wideband codebook is predicted on the basis of a narrowband (telephone-band) codebook in regard to frequency extension. At the same time, an excitation signal is separately subjected to low-band extension and high-band extension and then the extended signals are synthesized through linear predictive coding (LPC) in a synthesis stage. The result of the linear prediction coding is combined with the result of the frequency extension.

On the other hand, the method based on the example shown in FIG. 3 requires a large amount of computation and it is thus difficult to use as an element technique of the voice encoder. For example, performance degradation is likely to occur due to the feature vectors increasing with an increase in processing band. The performance deviation may increase depending on the characteristics of a training database. It is also difficult to use the method based on the example shown in FIG. 3 to predict an SWB signal which is processed in the MDCT domain.

Figure 4:
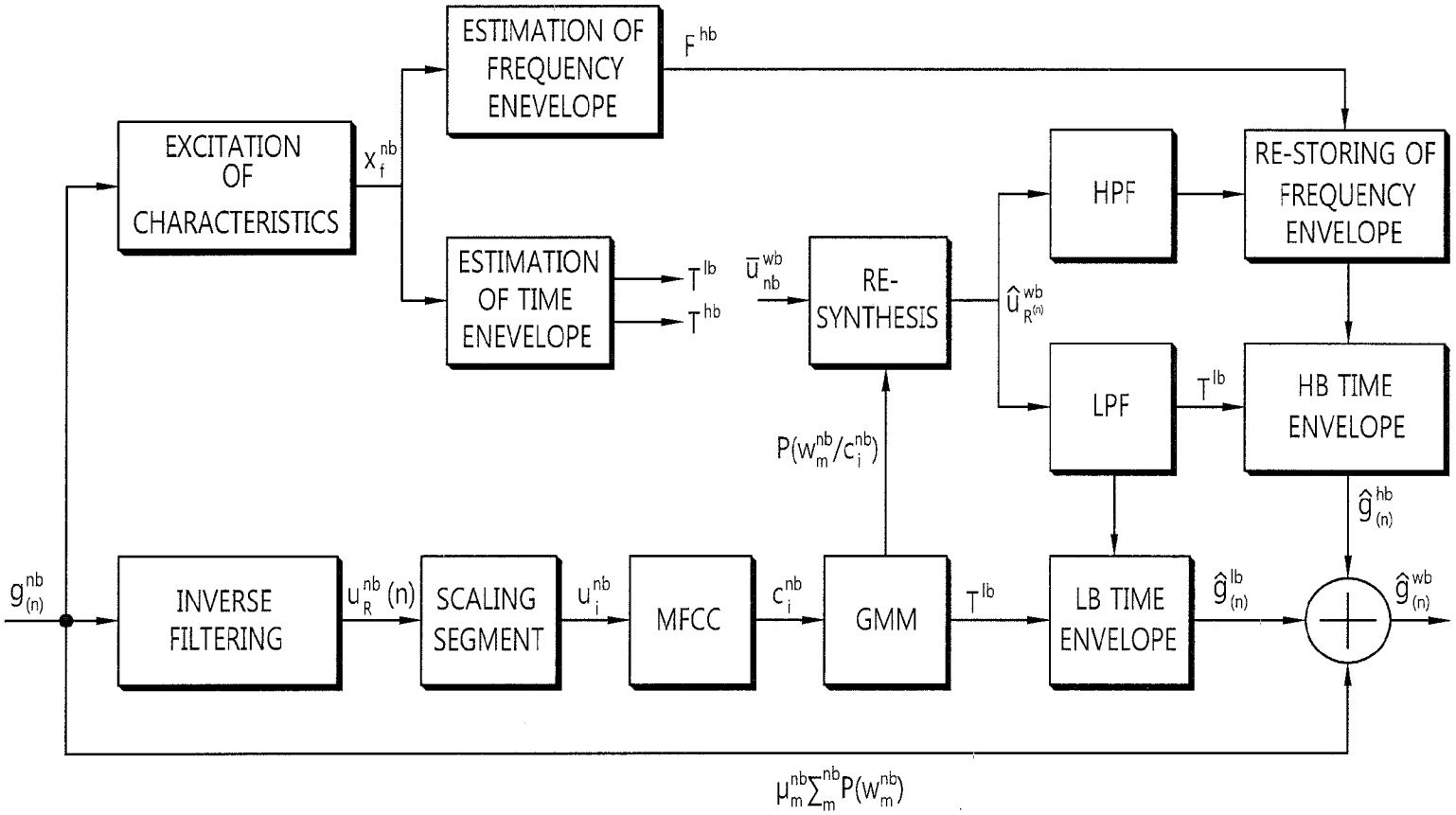
FIG. 4 is a diagram schematically illustrating an example where the ABE is applied on the basis of a bandwidth extension technique.

FIG. 4 is a diagram schematically illustrating an example where the ABE is applied on the basis of a bandwidth extension technique. The ABE method based on the spectral envelope prediction technique and the excitation signal prediction method and the ABE method shown in FIG. 4 are applied on the basis of an existing bandwidth extension technique.

Referring to FIG. 4, envelope information in the time domain along with envelope information in the frequency domain is predicted along the time axis. For example, the GMM is applied using the MFCC extracted from a low-band signal as a feature vector so as to predict parameters necessary for synthesis of a high-band signal.

According to the method described with reference to the example shown in FIG. 4, the ABE can be performed by predicting only the parameters defined in the existing bandwidth extension method and re-using the existing method for the structure necessary for predicting the other parameters.

However, the method shown in FIG. 4 is poor at generality. For example, since a part corresponding to the excitation signal is predicted in advance and utilized, information to be predicted is relatively limited.

The bandwidth extension method shown in FIG. 4 is difficult to use with the band characteristics ignored. That is, the bandwidth extension method shown in FIG. 4 has been developed for bandwidth extension to a wide band, the method is difficult to apply for reconstructing an SWB signal from a WB signal. Particularly, this method is a method of which the performance is guaranteed when a signal of a baseline band is sufficiently reconstructed. Accordingly, when the signal of a baseline band can be reconstructed only in the encoder, it is difficult to obtain a desired effect.

Therefore, it is necessary to consider a bandwidth extension technique capable of maintaining generality without causing a large amount of computation and without greatly depending on the characteristics of the database.

In the invention, a bandwidth is extended without using any additional bit. That is, an input WB signal (for example, a signal input with a sampling frequency of 16 kHz) can be output as an SWB signal (for example, a signal with a sampling frequency of 32 kHz) without using any additional bit.

The bandwidth extension method according to the invention can also be applied to (mobile, wireless) communications. A bandwidth can be extended without additional delay other than the MDCT transform.

The bandwidth extension method according to the invention can use a frame of the same length as the frame of a baseline encoder/decoder in consideration of the generality. For example, when G.718 is used as the baseline encoder, the length of a frame can be set to 20 ms. In this case, 20 ms corresponds to 640 samples based on a signal of 32 kHz.

Table 1 schematically shows an example of a specification when the bandwidth extension method according to the invention is used.

TABLE 1

| Item | Details |
|---|---|
| Additional bit rate | 0 kbit/s |
| Input and output sampling frequency | Input: 16 kHz<br>Output: 32 kHz |
| Additional algorithm delay | 0 ms (except MDCT) |
| Frame length | 20 ms |
| Additional amount of computation | 15 WMOPS (except MDCT) |
| Additional memory | 10 kword (except MDCT) |
| Additional processing band | 7,000 to 14,000 Hz |

Figure 5:
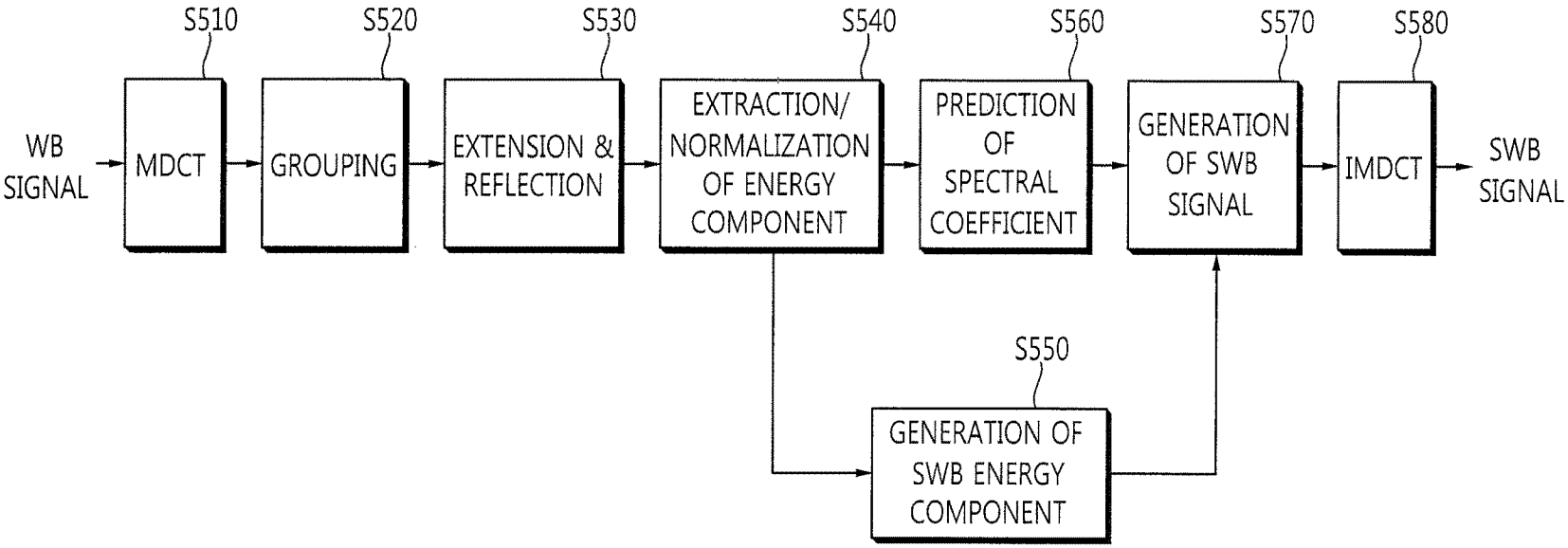
FIG. 5 is a flowchart schematically illustrating a method of extending a band according to the invention.

FIG. 5 is a flowchart schematically illustrating the bandwidth extending method according to the invention. FIG. 5 shows a re-sampling method of receiving a WB signal and outputting an SWB signal.

The steps shown in FIG. 5 can be performed by an encoder and/or decoder. For the purpose of convenience for explanation, it is assumed in FIG. 5 that the steps are performed by a bandwidth extension device in the encoder and/or decoder. The bandwidth extension device may be disposed in the band predicting unit or the band synthesizing unit of the decoder or may be disposed as a particular unit in the decoder.

The steps shown in FIG. 5 may be performed by the bandwidth extension device or may be performed by mechanical units corresponding to the steps.

The bandwidth extension method shown in FIG. 5 can be approximately divided into four steps. For example, these four steps include (1) a step of transforming an input signal to an MDCT domain, (2) a step of generating an extended signal and a reflected signal to generate a high-band signal using a low-band (wideband) input signal, (3) a step of generating energy components and normalized spectral bin components so as to generate a high-band signal, and (4) a step of generating and outputting an extended signal of the input signal.

Referring to FIG. 5, the bandwidth extension device receives a WB signal and performs an MDCT thereon (S510).

The input WB signal may be a mono signal sampled at 32 kHz and may be transformed in a time/frequency (T/F) transform manner through the MDCT. The use of the MDCT is mentioned herein, but another transform method of performing the time/frequency transform may be used.

When the input signal is sampled at 32 kHz, one frame of the input signal includes 320 samples. Since the MDCT has an overlap-and-add structure, the time/frequency (T/F) transform is performed to 640 samples including 320 samples constituting a previous frame of a current frame.

The input signal is subjected to the MDCT to generate a spectral bin $X_{WB}(k)$. $X_{WB}(k)$ represents the k-th spectral bin and k represents a sampling frequency or a frequency component. The spectral bin may be analyzed as an MDCT coefficient obtained by performing the MDCT. When the input signal is sampled at 32 kHz, 320 spectral bins ($1 \leq k \leq 320$) are generated.

320 spectral bins correspond to 0 to 8 kHz, but the bandwidth extension is performed using 280 spectral bins corresponding to a wideband (a bandwidth of 7 kHz) out of the spectral bins. Therefore, an SWB signal $X_{SWB}(k)$ is generated as a reconstructed signal including 560 spectral bins as the result of the bandwidth extension according to the invention.

The bandwidth extension device groups the spectral bins generated through the MDCT into sub-bands including a predetermined number of spectral bins (S520). For example, the number of spectral bins for each sub-band can be set to 10. Therefore, the bandwidth extension device constructs 28 sub-bands from the input signal and generates an output signal including 56 sub-bands on the basis thereon.

The bandwidth extension device generates an extended band signal $X_{Ext}(k)$ and a reflected band signal $X_{Ref}(k)$ by extending and reflecting 28 sub-bands constructed from the input signal (S530). The extended band signal is generated through spectral interpolation and the reflected band signal is generated through low-band spectral folding. These processes will be described later.

The bandwidth extension device extracts energy components from each of the sub-band signals and normalizes each of the sub-band signals (S540). The bandwidth extension device divides the input signal (wideband signal) into energy components $G_{WB}(j)$ and normalized spectral bin components $\tilde{X}_{WB}(k)$. The bandwidth extension device divides the extended band signal $X_{Ext}(k)$ into energy components $G_{Ext}(j)$ and normalized spectral bin components $\tilde{X}_{Ext}(k)$. The bandwidth extension device divides the reflected band signal $X_{Ref}(k)$ into energy components $G_{Ref}(j)$ and normalized spectral bin components $\tilde{X}_{Ref}(k)$. On the other hand, the input signal which is a wideband signal can be referred to as a low-band signal in comparison with the extended band signal and the reflected band signal which are the high-band signals. The input signal constructs a super-wideband signal along with the extended band signal and the reflected band signal. On the other hand, j in the energy components is an index indicating the sub-band into which the spectral bins are grouped.

The bandwidth extension device generates the energy components $G_{SWB}(j)$ of the super-wideband signal on the basis of the energy components $G_{WB}(j)$, $G_{Ext}(j)$, and $G_{Ref}(j)$ (S550). The method of synthesizing and generating the energy components of the super-wideband signal will be described later.

The bandwidth extension device predicts spectral coefficients (MDCT coefficients) (S560). The bandwidth extension device can calculate an optimal fetch index using cross correlation between the normalized spectral bin components $\tilde{X}_{WB}(k)$ of the input signal and the normalized spectral bin components $\tilde{X}_{Ext}(k)$ of the extended band signal. The bandwidth extension device generates the normalized spectral bin components $\tilde{X}_{SWB}(k)$ of the super-wideband signal on the basis of the calculated fetch index.

The bandwidth extension device generates the super-wideband signal $X_{SWB}(k)$ using the energy component $G_{SWB}(j)$ of the super-wideband signal and the normalized spectral bin components $\tilde{X}_{SWB}(k)$ of the super-wideband signal (S570).

The specific method of generating the super-wideband signal $X_{SWB}(k)$ will be described later.

Then, the bandwidth extension device performs an inverse MDCT (IMDCT) and outputs the reconstructed super-wideband signal (S580).

As described above, the bandwidth extension device includes the mechanical units corresponding to the steps S510 to S580. For example, the bandwidth extension device includes an MDCT unit, a grouping unit, an extension and reflection unit, an energy component extraction and normalization unit, an SWB energy component generating unit, a spectral coefficient predicting unit, an SWB signal generating unit, and an IMDCT unit. At this time, the operations performed by the mechanical units are the same as described in the corresponding steps.

Figure 6:
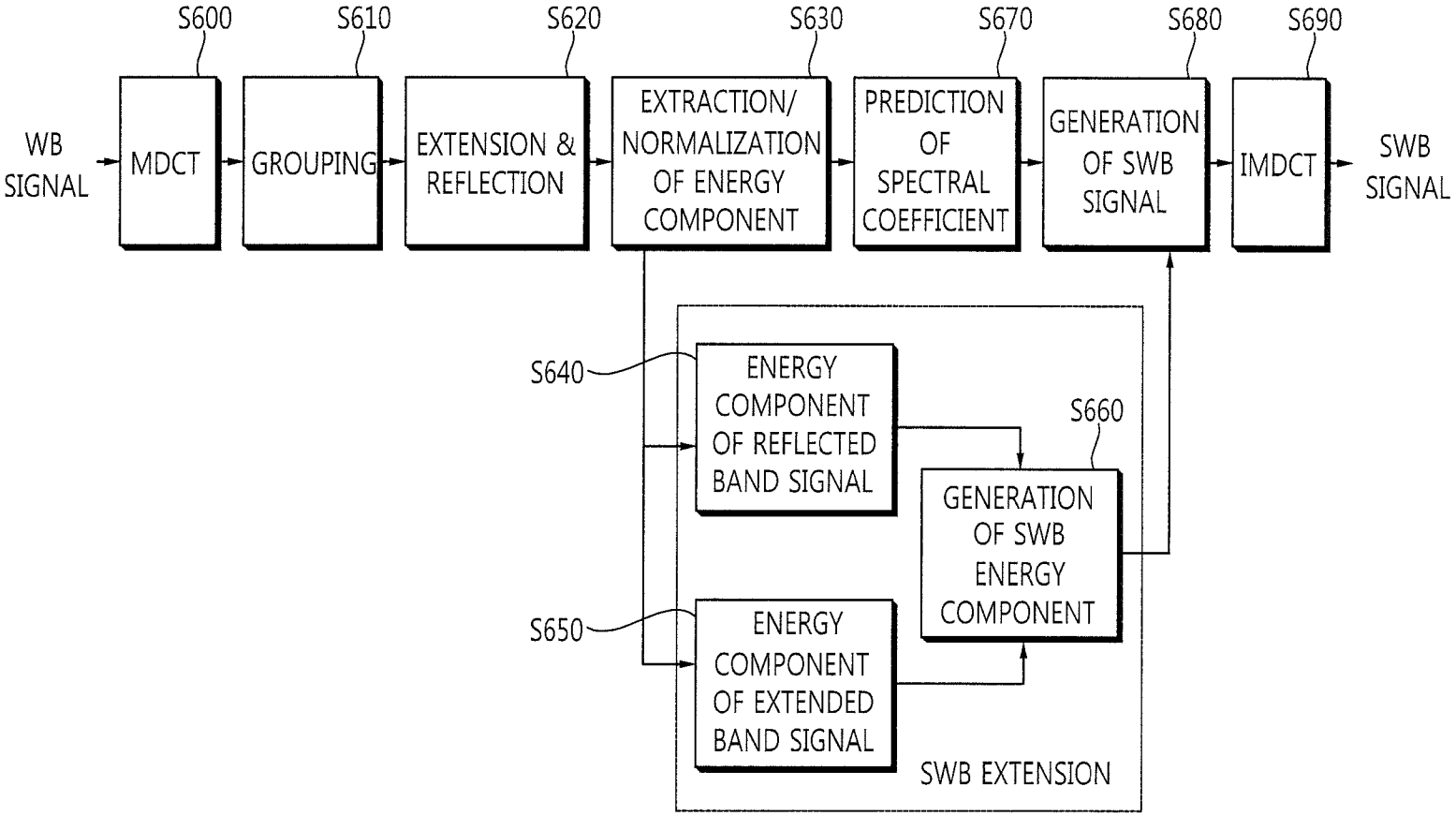
FIG. 6 is a flowchart schematically illustrating another method of the bandwidth extension method which is performed by a bandwidth extension device according to the invention.

FIG. 6 is a flowchart schematically illustrating another example of the bandwidth extension method which is performed by the bandwidth extension device according to the invention. Similarly to the example shown in FIG. 5, the example shown in FIG. 6 includes the same MDCT performing step (S600) as in S500, the same grouping step as in S510 (S610), the same extension and reflection step (S620) as in S520, an energy extraction/normalization step (S630) corresponding to S540, an SWB extension step (S640, S650, and S660) corresponding to S550, the same spectral coefficient predicting step (S670) as in S560, the same SWB signal generating step (S680) as in S570, and the same IMDCT step (S690) as in S580.

In FIG. 6, unlike in FIG. 5, only the energy components $G_{WB}(j)$ of the input signal are extracted in the energy extraction/normalization step, the step (S640) of extracting the energy components $G_{Ref}(j)$ of the reflected band signal and the step (S650) of extracting the energy components $G_{Ext}(j)$ of the extended band signal on the basis thereof are performed in the SWB extension step. In the SWB extension step, the energy components $G_{SWB}(j)$ of the super-wideband signal are generated on the basis of $G_{Ref}(j)$, $G_{Ext}(j)$, and the energy components $G_{WB}(j)$ of the input signal (S660).

In the example shown in FIG. 6, the bandwidth extension device includes the mechanical units corresponding to the steps S600 to S690. For example, the bandwidth extension device includes an MDCT unit, a grouping unit, an extension and reflection unit, an energy component extraction and normalization unit, an SWB extension unit (a reflected-band-signal energy component extracting unit, an extended-band-signal energy component extracting unit, and an SWB-signal energy component generating unit), a spectral coefficient predicting unit, an SWB signal generating unit, and an IMDCT unit. At this time, the operations performed by the mechanical units are the same as described in the corresponding steps.

When the steps shown in FIGS. 5 and 6 are approximately divided into four steps described above, (1) the step of transforming an input signal to an MDCT domain includes the MDCT step (S510 and S600), (2) the step of generating an extended signal and a reflected signal to generate a high-band signal using a low-band (wideband) input signal includes the grouping step (S520 and S610) and an extension and reflection step (S530 and S620), (3) the step of generating energy components and normalized spectral bin components so as to generate a high-band signal includes the energy components extracting and normalizing step (S540, S630, S640, and S650), the MDCT coefficient predicting unit (S560 and S670), and the high-band energy synthesizing step (S550 and S660), and (4) the step of generating and outputting an extended signal of the input signal includes the super-wideband signal synthesizing unit (S570 and S680) and the IMDCT step (S580 and S690).

The bandwidth extension device having the configurations shown in FIGS. 5 and 6 can operate as an independent module in the decoder. The bandwidth extension device may operate as a part of the band predicting unit or the band synthesizing unit of the decoder.

On the other hand, when a layer structure is employed and the encoder reconstructs and processes a high-band signal on the basis of a signal of a previous layer, the encoder also includes the bandwidth extension device according to the invention.

The method of constructing an extended band signal and a reflected band signal according to the invention, the method of extracting energy components and generating normalized components, the method of synthesizing energy components of a SWB signal, the method of calculating a fetch index and generating normalized components of the SWB on the basis thereon, the method of smoothing the energy components, and the method of synthesizing an SWB signal will be described below.

<Construction of Extended Band Signal/Construction of Reflected Band Signal>

In the bandwidth extension method according to the invention, a signal of a higher-band than an input signal (WB signal) is processed and an SWB signal is output.

When the input signal is a WB signal of about 50 Hz to 7 kHz, a band to be additionally processes has a bandwidth of 7 kHz ranging from 7 kHz to 14 kHz. At this time, the band to be additionally processed has the same bandwidth as the processing bandwidth of the encoder used as a baseline encoder. That is, when the processing bandwidth of the baseline encoder is 7 kHz, the band to be additionally processed has a bandwidth of 7 kHz so as to reconstruct an SWB signal while using the baseline encoder without any change.

At this time, when a low-band signal is fetched to extend the bandwidth of the low-band (wideband) input signal, several problems occur. For example, the fetch index has to have a value of 280 to use the first to 280-th spectral bins corresponding to the input signal of 7 kHz as the 281-th to 560-th spectral bins corresponding to the band of 7 kHz to 14 kHz. However, in this case, since the fetch index is fixed, it is difficult to variously select/calculate the fetch index. Since low-band components having a strong harmonic characteristic are used as the extended band signal of 7 to 8 kHz, degradation in sound quality may occur.

However, when some of the low-band signals are not used to solve such problems, it is not possible to reconstruct an super-wideband signal by extending a bandwidth of 7 kHz.

Therefore, it is necessary to change the bandwidth before extending the bandwidth.

In the bandwidth extension method according to the invention, an extended band signal $X_{Ext}(k)$ is constructed before extending the bandwidth using the low-band signal. Accordingly, it is possible to broaden the choice for fetch (choice of a fetch index) and to extend the bandwidth of 7 kHz even without processing the low-band components having a harmonic characteristic in a band (section) which is fetched to generate an SWB signal.

The extended band signal $X_{Ext}(k)$ can be generated through double spectral stretching of double extending the spectrums of a series of signals $X_{WB}(k)$. This can be mathematically expressed by Expression 1

$$X_{Ext}(k) = \begin{cases} X_{WB}(k/2), & k = 0, 2, 4, \ldots, N-4, N-2 \\ 0, & k = 1, 3, 5, \ldots, N-3, N-1 \end{cases} \quad \text{Expression 1}$$

Here, N represents the number corresponding to double the number of sampled input signals. For example, when kin the input signal $X_{WB}(k)$ satisfies $1 \le k \le 280$, N may be 560.

On the other hand, when a bandwidth is extended using Expression 1, noise may occur in the finally-reconstructed SWB signal due to an energy component different and a phase component difference between the existing low-band signal $X_{WB}(k)$ and the extended signal $X_{Ext}(k)$. To solve this problem, the energy differences may be compensated at the boundary between the low-band signal $X_{WB}(k)$ and the extended signal $X_{Ext}(k)$ through the use of an energy matching process. However, since the energy compensation is carried out in the unit of frame, the time/frequency transform resolution is limited.

Therefore, in order to prevent noise from occurring in the invention, a reflected band signal $X_{Ref}(k)$ is generated and the bandwidth extension is carried out using both the reflected band signal and the extended band signal.

The reflected band signal $X_{Ref}(k)$ is generated by reflecting the low-band (wideband) input signal into a high-band signal. This can be mathematically expressed by Expression 2.

$$X_{Ref}(k+280)=X_{WB}(279-k),\ 0 \le k \le N_w \quad \text{Expression 2}$$

In Expression 2, the case that the input signal a WB signal including 280 samples is explained as an example. In Expression 2, $N_w$ represents the length of an overlap-and-add window used to synthesize the reflected band signal. This will be described again in description of synthesis of energy components.

<Extraction and Normalisation of Energy Component>

In the bandwidth extension method according to the invention, the energy component and the normalized spectral bin of the SWB signal to be reconstructed are predicted using independent methods.

First, energy components are extracted from the signals. For example, the energy component $G_{WB}(j)$ of the low-band (wideband) input signal $X_{WB}(k)$ is extracted, the energy component $G_{Ext}(j)$ of the extended band signal $X_{Ext}(k)$ is extracted, and the energy component $G_{Ref}(j)$ of the reflected band signal $X_{Ref}(k)$ is extracted.

The energy components of the sub-bands for each the signal can be extracted as average values of the gains of the signals in the corresponding sub-bands. This can be mathematically expressed by Expression 3.

$$G_{XX}(j) = \frac{1}{10}\sqrt{\sum_{k=0}^{9} X_{XX}^2(k+10\times j)}, \quad 0 \le j \le M_{XX}-1 \quad \text{Expression 3}$$

In Expression 3, XX represents any one of WB, Ext, and Ref. For example, regarding the energy component of the low-band (wideband) input signal $X_{WB}(k)$, $G_{XX}(j)$ is $G_{WB}(j)$. Regarding the energy component of the extended band signal $X_{Ext}(k)$, $G_{XX}(j)$ is $G_{Ext}(j)$. Regarding the energy component of the reflected band signal $X_{Ref}(k)$, $G_{XX}(j)$ is $G_{Ref}(j)$.

In Expression 3, $M_{XX}$ represents the number of sub-bands for each signal. For example, $M_{WB}$ represents the number of sub-bands belonging to the low-band (wideband) input signal, $M_{Ext}$ represents the number of sub-bands belonging to the extended band signal, and $M_{Ref}$ represents the number of sub-bands belonging to the reflected band signal. $M_{WB}$ for the energy component $G_{WB}(j)$ of the input signal including 280 spectral bins, as in the embodiment of the invention, is 28, $M_{Ext}$ for the energy component $G_{Ext}(j)$ of the extended band signal including 560 spectral bins is 56, and $M_{Ref}$ for the energy component $G_{Ref}(j)$ of the reflected band signal including 140 spectral bins is 14. The number of spectral bins constituting the reflected band signal will be described later.

The spectral bins of each signal can be normalized on the basis of the energy components of the signals. For example, a normalized spectral bin is a ratio of the spectral bin to the corresponding energy component. Specifically, a normalized spectral bin is defined as a ratio of the spectral bin to the corresponding energy component of the sub-band signal to which the spectral bin belongs. This can be mathematically expressed by Expression 4.

$$\tilde{X}_{XX}(k+10\times j)=\frac{X_{XX}(k+10\times j)}{G_{XX}(j)},\quad 0\le j\le M_{XX}-1,\ 0\le k\le K_{XX} \qquad \text{Expression 4}$$

In Expression 4, $K_{XX}$ represents the number of spectral bins. Therefore, $K_{XX}$ is $10M_{XX}$. For example, as in the embodiment of the invention, $K_{WB}$ of the input signal $X_{WB}(k)$ including 280 spectral bins is 280, $K_{Ext}$ of the extended band signal $X_{Ext}(k)$ including 560 spectral bins is 560, and $K_{Ref}$ of the reflected band signal $X_{Ref}(k)$ including 140 spectral bins is 140.

Therefore, the normalized spectral bins corresponding to the frequency components can be obtained.

<Energy Component Synthesis of Super-wideband Signal>

In the bandwidth extension method according to the invention, the high-band energy components of an SWB signal are generated using the energy components $G_{Ext}(j)$ of the extended band signal and the energy components $G_{Ref}(j)$ of the reflected band signal generated on the basis of the low-band input signal $X_{WB}(k)$.

Specifically, in the invention, the energy components of an intermediate band between the lower band and the upper band in the SWB signal to be reconstructed are generated by overlapping and adding the energy components of the extended band signal and the energy components of the reflected band signal. A window function can be used to overlap and add the energy components of the extended band signal and the energy components of the reflected band signal. For example, in the invention, the energy components of the intermediate band may be generated using Hanning windowing.

The energy components of the upper band in the SWB signal to be reconstructed can be generated using the extended band signal.

Figure 7:
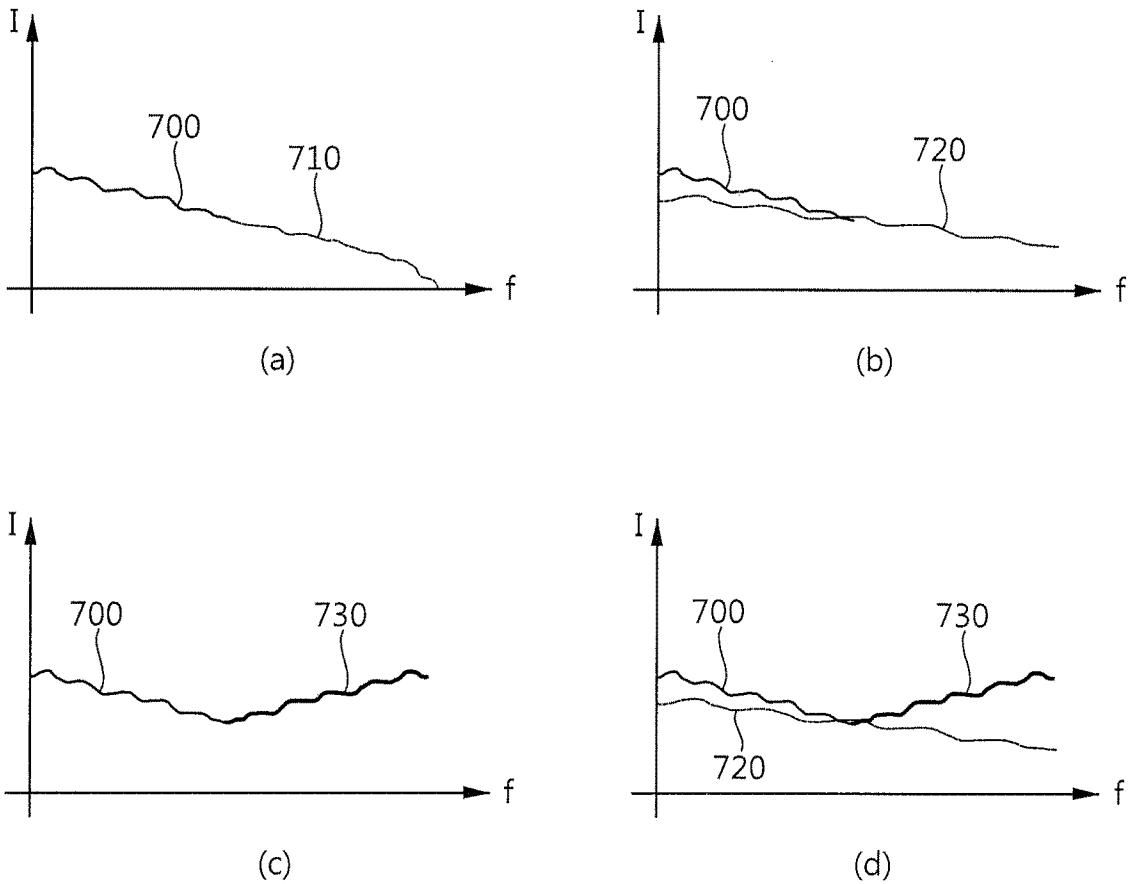
FIG. 7 is a diagram schematically illustrating a method of synthesizing an energy component of a SWB signal according to the invention.

FIG. 7 is a diagram schematically illustrating a method of synthesizing the energy components of the SWB signal according to the invention. In (*a*) to (*d*) of FIG. 7, the vertical axis represents the gain or the intensity (I) of a signal, and the horizontal axis represents the band, that is, the frequency (f), of a signal.

Referring to (*a*) of FIG. 7, when the energy components 700 of the low-band (wideband) input signal are extended to a upper band without any change, the energy components 710 shown in the drawing are obtained. However, as described above, when the input signal is used as the high-band signal without any change, a problem may be caused in sound quality and a problem may be caused in generality of the baseline encoder/decoder.

Therefore, in the invention, the energy components of the SWB signal are reconstructed by generating the energy components 720 of the extended band signal as shown in (b) of FIG. 7 and generating the energy components 730 of the reflected band signal as shown in (c) of FIG. 7. That is, the SWB signal is reconstructed at the boundary between the low-band (wideband) input signal and the extended band signal using the reflected band signal.

As described above, since the extended band signal is generated by spectrally interpolating, that is, spectrally stretching, the input signal, the extended band signal has a slope smaller than that of the input signal. Therefore, the extended band signal cannot be matched with the termination portion (a portion of k=280 and the neighboring portion) or the cross correlation in the termination portion of the input signal may be lowered.

Therefore, in the termination portion of the input signal, the energy components of the SWB signal are reconstructed by giving a weight to the energy components of the reflected band signal generated by reflecting the input signal as described above.

(d) of FIG. 7 schematically illustrates an example where the energy components of the SWB signal are synthesized using the energy components of the input signal, the energy components of the extended band signal, and the energy components of the reflected band signal. Referring to (d) of FIG. 7, the connection between the energy components of the input signal and the energy components of the reflected band signal is more accurate than the connection between the energy components of the input signal and the energy components of the extended band signal.

Therefore, the energy components of the intermediate band between the low-band signal (input signal) and the high-band signal can be synthesized by weighting the energy components of the reflected band signal and the energy components of the extended band signal. At this time, the length of the intermediate band is equal to the length of the overlap-and-add window described in Expression 2.

For example, the energy components of the reflected band signal are weighted for the lower part of the intermediate band (a part close to the input signal), and the energy components of the extended band signal are weighted for the upper part of the intermediate band. At this time, the weights can be given as a window function.

In the upper band higher than the intermediate band, the energy components of the extended band signal are used as the energy components of the SWB signal.

In an embodiment of the invention, when a low-band (wideband) input signal $X_{WB}(k)$ includes 28 (where $0\le j\le 27$) sub-band signals, and the energy components of the extended band signal and the energy components of the reflected band signal are overlapped and added in a predetermined band (for example, a half of the extended band), the energy components of the SWB signal to be reconstructed can be obtained by Expression 5.

$$G_{SWB}(j) = \begin{cases} G_{WB}(j), & 0 \le j \le 27 \\ G_{Ref}(j)w(N-14+j-28) + G_{Ext}(j)w(j-28), & 28 \le j \le 41 \\ G_{Ext}(j), & 42 \le j \le 55 \end{cases} \quad \text{Expression 5}$$

In Expression 5, w represents a Hanning window and w(n) represents the n-th value of the Hanning window including 56 samples. The Hanning window is an example of the overlap-and-add window described in Expression 2.

At this time, unlike Expression 5, when the Hanning window is applied in consideration of only the upper band higher than the band of the input signal, Expression 6 can be established. Here, $G_{SWB}(j)$ in Expression 6 represents only the energy components of the signal in the band higher than the band of the $G_{WB}(j)$.

$$G_{SWB}(j) = \begin{cases} G_{Ref}(j+28)w(N-14+j) + G_{Ext}(j+28)w(j), & 0 \le j \le 13 \\ G_{Ext}(j), & 14 \le j \le 27 \end{cases} \quad \text{Expression 6}$$

In Expression 6, w(n) represents the n-th value of the Hanning window including 28 samples.

The Hanning window causes the magnitude of the signal to converge on 0 at the start and the end of a predetermined part when the corresponding part of a continuous signal is specified.

Expression 7 shows an example of the Hanning window which can be applied to Expressions 5 and 6 according to the invention.

$$w(n) = 0.5\left(1 - \cos\left(\frac{2\pi n}{N-1}\right)\right), 0 \le n \le N-1 \quad \text{Expression 7}$$

The length of the Hanning window in Expression 7 is a length of the intermediate band (28≤j≤41) of Expression 5 or the intermediate band (0≤j≤13) of Expression 6, and the length of the Hanning window is a length of the overlap-and-add window described in Expression 2. When the Hanning window of Expression 7 is applied to Expression 5, the value of N is 56. When the Hanning window of Expression 7 is applied to Expression 6, the value of N is 28.

The invention will be described below with reference to Expression 5. Referring to Expression 7, in the overlapping and adding of the intermediate band (28≤j≤41) of Expression 5, the values of the window for the energy components of the extended band signal are 0 at the start point (j=28) of the intermediate band and the values of the window for the energy components of the reflected band signal are 0 at the end point (j=41) of the intermediate band. That is, the energy components of the reflected band signal are weighted in the lower part (a part close to the input signal) of the intermediate band, and the energy components of the extended band signal are weighted in the upper part of the intermediate band.

Referring to Expression 5, as described above, the energy components of the input signal (wideband signal) are used as the energy components in the low-band part of the SWB signal in the bandwidth extension according to the invention.

When Expression 6 is used, the invention can be embodied in the same way as described above. In this case, the Hanning window is applied with the value of N set to 28. It should be noted that the energy components of the SWB signal obtained using Expression 6 is obtained by excluding the low-band energy components $G_{WB}(j)$ from the energy components of the overall SWB signal and the energy components of the overall SWB signal are obtained using both $G_{SWB}(j)$ and $G_{WB}(j)$ obtained using Expression 6.

<Fetch Index of Normalized Spectral Bin>

In the bandwidth extension method according to the invention, the cross correlation is used to determine the optimal fetch index.

That is, the normalized spectral bin components of the SWB signal includes the normalized spectral bin components of the input signal (wideband signal) and the normalized spectral bin components of the extended band signal. At this time, the relationship between the normalized spectral bin components of the extended band signal and the normalized spectral bin components of the SWB signal to be reconstructed can be set using the fetch index.

For example, the normalized spectral bin of the extended band signal of which the cross correlation with the normalized spectral bin components of the input signal is the highest is determined. The normalized spectral bin component of the extended band signal having the highest cross correlation can be specified using the value of the frequency k. Therefore, the normalized spectral bin in the upper band of the SWB signal higher than the band of the input signal can be determined using the frequency specifying the normalized spectral bin of the extended band signal having the highest cross correlation.

The method of determining the frequency, that is, the fetch index, specifying the normalized spectral bin of the extended band signal having the highest cross correlation will be specifically described below.

The cross correlation section and the cross correlation index have a trade-off relationship therebetween. The cross correlation section means a section which is used to calculate the cross correlation, that is, a band in which the cross correlation is determined. The cross correlation index indicates a specific frequency used to calculate the cross correlation. The number of selectable cross correlation indices decreases when the cross correlation section is broadened, and the number of selectable cross correlation indices increases when the cross correlation section is narrowed.

By considering that the lower band of the input signal band includes a strong signal, the cross correlation section can be set to a partial upper band of the input signal band so as to avoid occurrence of an error.

In the bandwidth extension method according to the invention, when the wideband signal as the input signal includes 280 samples of the 7 kHz band (0≤k≤279), the fetch index (the maximum cross correlation index) is determined so that the sum of the number of cross correlation sections and the number of cross correlation indices is 140.

The maximum cross correlation index indicates the frequency for specifying the normalized spectral bin component of the extended band signal having the highest cross correlation with the normalized spectral bin components of the input signal in the cross correlation section.

In the embodiment of the invention, for the purpose of convenience for explanation, a case where the cross correlation section is set to a section corresponding to 80 samples and the number of cross correlation indices i (that is, the number of shifts when the cross correlation is measured while shifting the samples) is set to 60 will be described.

In this case, the maximum cross correlation index max_index can be determined to be the value of k having the highest cross correlation between the normalized spectral bin components of the input signal and the normalized spectral bin components of the extended band signal out of 60 values of k in the section of 200≤k≤279 of the input signal band 0≤k≤279.

This can be mathematically expressed by Expression 8

$$\text{max_index} = \underset{0 \le i < 60}{\operatorname{argmax}} CC\left(\tilde{X}_{Ext}(i+140), \tilde{X}_{WB}(200)\right) \quad \text{Expression 8}$$

Here, CC(x(m), y(n)) represents a cross correlation function and is defined by Expression 9.

$$CC(x(m)y(n)) = \sum_{k=0}^{59} x(m+k)y(n+k) \quad \text{Expression 9}$$

As described above, the normalized spectral bin components in the upper band of the SWB signal to be reconstructed can be determined using the maximum cross correlation index max_index.

For example, when the WB signal as the input signal includes 280 samples of a 7 kHz band, the normalized spectral bin component in the k-th frequency component after the 280-th sampling frequency in the SWB signal is the normalized spectral bin component of the extended band signal in the k-th frequency component from the maximum cross correlation. This can be mathematically expressed by Expression 10

$$\tilde{X}_{SWB}(k+280) = \tilde{X}_{Ext}(k+\text{max_index}),\ 0 \le k \le 279 \quad \text{Expression 10}$$

<Energy Smoothing>

Since the energy components $G_{SWB}(j)$ of the SWB signal generated as described above are generated by combining the energy components $G_{Ext}(j)$ of the extended band signal and the energy components $G_{Ref}(j)$ of the reflected band signal, the components in the 14 kHze band may be predicted to be great.

Noise may be mixed into the high-frequency components due to this prediction error. That is, when the upper band of the SWB signal is terminated with a high gain, degradation in sound quality may be caused.

Therefore, in the invention, some upper energy components in the upper band of the synthesized energy components of the SWB signal can be smoothed. The smoothing gives a certain attenuation to the energy components depending on the frequency components.

For example, when 10 energy components in the upper band are smoothed, the energy components of the SWB signal can be smoothed as expressed by Expression 11.

$$G_{SWB}(j) = \begin{cases} G_{SWB}(j), & 0 \le j \le 45 \\ G_{SWB}(j) \times (0.9)^{j-45}, & 46 \le j \le 55 \end{cases} \quad \text{Expression 11}$$

<Synthesis of Super-wideband (SWB) Signal>

In the bandwidth extension method according to the invention, the SWB signal can be reconstructed on the basis of the generated energy components $G_{SWB}(j)$ of the SWB signal and the normalized spectral bins of the SWB signal. The SWB signal in the k-th frequency component can be expressed as a signal having energy in the sub-band j to which the k-th frequency component belongs by using the normalized spectral bins of the SWB signal in the k-th frequency component as a time/frequency transform coefficient.

This can be mathematically expressed by Expression 12.

$$X_{SWB}(k) = \tilde{X}_{SWB}(k) \times G_{SWB}\left(\left\lfloor \frac{k}{10} \right\rfloor\right),\ 0 \le k \le 559 \quad \text{Expression 12}$$

In Expression 12, ⌊k⌋ represents an integer not greater than k. Since one sub-band includes 10 spectral bins, the sub-band index j indicates the group of 10 spectral bins. Therefore, ⌊k⌋ represents the sub-band to which the corresponding spectral bin belongs and $$G_{SWB}\left(\left\lfloor \frac{k}{10} \right\rfloor\right)$$

represents the energy component of the corresponding sub-band.

While the methods in the above-mentioned exemplary system have been described on the basis of flowcharts including a series of steps or blocks, the invention is not limited to the order of steps and a certain step may be performed in a step or an order other than described above or at the same time as described above. The above-mentioned embodiments can include various examples. Therefore, it should be understood that the invention includes all other substitutions, changes, and modifications belonging to the appended claims.

When it is mentioned above that an element is "connected to" or "coupled to" another element, it should be understood that still another element may be interposed therebetween, as well as that the element may be connected or coupled directly to another element. On the contrary, when it is mentioned that an element is "connected directly to" or "coupled directly to" another element, it should be understood that still another element is not interposed therebetween.

The invention claimed is:

1. A method for extending bandwidth of audio signal performed by a decoding apparatus, the method comprising:

receiving, by the decoding apparatus from an audio input device, a wideband (WB) audio signal;

generating, by the decoding apparatus, a first transform audio signal on the basis of a modified discrete cosine transform (MDCT) from the WB audio signal;

generating, by the decoding apparatus, a second transform audio signal and a third transform audio signal on the basis of the first transform audio signal, wherein the second transform audio signal is an audio signal obtained by spectrally extending the first transform audio signal to an upper frequency band, and the third transform audio signal is an audio signal obtained by reflecting the first transform audio signal with respect to a first reference frequency band;

generating, by the decoding apparatus, normalized components and energy components of the first transform audio signal, the second transform audio signal, and the third transform audio signal therefrom;

generating, by the decoding apparatus, an extended normalized component from the normalized components, an extended energy component from the energy components, and an extended transform audio signal on the basis of the extended normalized component and the extended energy component;

reconstructing, by the decoding apparatus, a super-wideband audio signal (SWB) on the basis of an inverse modified discrete cosine transform (IMDCT) from the extended transform audio signal; and transmitting, by the decoding apparatus to an audio output device, the SWB audio signal, wherein the SWB audio signal is reconstructed by extending the bandwidth of the WB audio signal without additional information except for the WB audio signal, wherein the extended energy component is the energy component of the first transform audio signal in a first energy section with a frequency bandwidth of K in which the first transform audio signal is defined, wherein the extended energy component is an overlap of the energy component of the second transform audio signal and the energy component of the third transform audio signal in a second energy section which is an upper section with a bandwidth of K/2 from the uppermost frequency band of the first energy section, and wherein the extended energy component is the energy component of the second transform audio signal in a third energy section which is an upper section with a bandwidth of K/2 from an uppermost frequency band of the second energy section.

2. The method of claim 1, wherein the second transform audio signal is an audio signal obtained by extending the audio signal band of the first transform audio signal two times to the upper frequency band.

3. The method of claim 1, wherein the third transform audio signal is an audio signal obtained by reflecting the first transform audio signal with respect to an uppermost frequency of the first transform audio signal, and wherein the third transform audio signal is defined in an overlap bandwidth centered on the uppermost frequency of the first transform audio signal.

4. The method of claim 3, wherein the third transform audio signal is synthesized with the first transform audio signal in the overlap bandwidth.

5. The method of claim 1, wherein the energy component of the first transform audio signal is an average absolute value of the first transform audio signal in a first frequency section, wherein the energy component of the second transform audio signal is an average absolute value of the second transform audio signal in a second frequency section, wherein the energy component of the third transform audio signal is an average absolute value of the third transform audio signal in a third frequency section, wherein the first frequency section is present in a frequency section in which the first transform audio signal is defined, wherein the second frequency section is present in a frequency section in which the second transform audio signal is defined, and wherein the third frequency section is present in a frequency section in which the third transform audio signal is defined.

6. The method of claim 5, wherein the widths of the first to third frequency sections correspond to 10 continuous frequency bands of frequency bands in which the first to third transform audio signals, wherein the frequency section in which the first transform audio signal is defined corresponds to 280 upper frequency bands continuous from a lowermost frequency band in which the first transform audio signal is defined, wherein the frequency section in which the second transform audio signal is defined corresponds to 560 upper frequency bands continuous from the lowermost frequency band in which the first transform audio signal is defined, and wherein the frequency section in which the third transform audio signal is defined corresponds to 140 frequency bands centered on an uppermost frequency band in which the first transform audio signal is defined.

7. The method of claim 1, wherein the normalized component of the first transform audio signal is normalized on the basis of the energy component of the first transform audio signal, wherein the normalized component of the second transform audio signal is normalized on the basis of the energy component of the second transform audio signal, and wherein the normalized component of the third transform audio signal is normalized on the basis of the energy component of the third transform audio signal.

8. The method of claim 1, wherein a weight is given to the energy component of the third transform audio signal in a first half of the second energy section and a weight is given to the energy component of the second transform audio signal in a second half of the second energy section.

9. The method of claim 1, wherein the extended normalized component is the normalized component of the first transform audio signal in a frequency band lower than the second reference frequency band and is the normalized component of the second transform audio signal in a frequency band higher than the second reference frequency band, and wherein the second reference frequency band is a frequency band in which a cross correlation between the first transform audio signal and the second transform audio signal is the maximum.

10. The method of claim 1, wherein the step of generating the extended normalized component and the extended energy component includes smoothing the extended energy component in an uppermost frequency band in which the extended energy component is defined.

11. An apparatus for decoding audio signal, the apparatus comprising:

at least one processor; and at least one memory storing executable instructions that, when executed by the at least one processor, cause the at least one processor to perform operations in which the apparatus:

receives, from an audio input device, a wideband (WB) audio signal, and generates a first transform audio signal on the basis of a modified discrete cosine transform (MDCT) from the WB audio signal;

generates a second transform audio signal and a third transform audio signal on the basis of the first transform audio signal, wherein the second transform audio signal is an audio signal obtained by spectrally extending the first transform audio signal to an upper frequency band, and the third transform audio signal is an audio signal obtained by reflecting the first transform audio signal with respect to a first reference frequency band;

generates normalized components and energy components of the first transform audio signal, the second transform audio signal, and the third transform audio signal therefrom;

generates an extended normalized component from the normalized components, an extended energy component from the energy components and an extended transform audio signal on the basis of the extended normalized component and the extended energy component; and reconstructs a super-wideband audio signal (SWB) on the basis of an inverse modified discrete cosine transform (IMDCT) from the extended transform audio signal and transmits, to an audio output device, the SWB audio signal, wherein the SWB audio signal is reconstructed by extending the bandwidth of the WB audio signal without additional information except for the WB audio signal, wherein the extended energy component is the energy component of the first transform audio signal in a first energy section with a frequency bandwidth of K in which the first transform audio signal is defined, wherein the extended energy component is an overlap of the energy component of the second transform audio signal and the energy component of the third transform audio signal in a second energy section which is an upper section with a bandwidth of K/2 from the uppermost frequency band of the first energy section, and wherein the extended energy component is the energy component of the second transform audio signal in a third energy section which is an upper section with a bandwidth of K/2 from an uppermost frequency band of the second energy section.

12. The apparatus of claim 11, wherein the energy component of the first transform audio signal is an average absolute value of the first transform audio signal in a first frequency section, wherein the energy component of the second transform audio signal is an average absolute value of the second transform audio signal in a second frequency section, and wherein the energy component of the third transform audio signal is an average absolute value of the third transform audio signal in a third frequency section.

13. The apparatus of claim 11, wherein the normalized component of the first transform audio signal is normalized on the basis of the energy component of the first transform audio signal, wherein the normalized component of the second transform audio signal is normalized on the basis of the energy component of the second transform audio signal, and wherein the normalized component of the third transform audio signal is normalized on the basis of the energy component of the third transform audio signal.

14. The apparatus of claim 11, wherein a weight is given to the energy component of the third transform audio signal in a first half of the second energy section and a weight is given to the energy component of the second transform audio signal in a second half of the second energy section.

15. The apparatus of claim 11, wherein the extended normalized component is the normalized component of the first transform audio signal in a frequency band lower than the second reference frequency band and is the normalized component of the second transform audio signal in a frequency band higher than the second reference frequency band, and wherein the second reference frequency band is a frequency band in which a cross correlation between the first transform audio signal and the second transform audio signal is the maximum.

* * * * *